US010961837B2

(12) United States Patent
Gillan et al.

(10) Patent No.: US 10,961,837 B2
(45) Date of Patent: Mar. 30, 2021

(54) DOWNHOLE 3D GEO STEERING VIEWER FOR A DRILLING APPARATUS

(71) Applicant: Nabors Drilling Technologies USA, Inc., Houston, TX (US)

(72) Inventors: Colin Gillan, Houston, TX (US); Matthew White, Spring, TX (US); Bosko Gajic, Kingwood, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 133 days.

(21) Appl. No.: 15/463,580

(22) Filed: Mar. 20, 2017

(65) Prior Publication Data

US 2018/0266245 A1 Sep. 20, 2018

(51) Int. Cl.

| | |
|---|---|
| ***E21B 44/00*** | (2006.01) |
| ***E21B 47/022*** | (2012.01) |
| ***E21B 7/06*** | (2006.01) |
| ***E21B 49/00*** | (2006.01) |

(52) U.S. Cl.

CPC ..... *E21B 44/00* (2013.01); *E21B 7/06* (2013.01); *E21B 47/022* (2013.01); *E21B 49/00* (2013.01)

(58) Field of Classification Search

CPC ..... E21B 49/003; E21B 44/00; E21B 7/06; E21B 49/00; E21B 47/022; G05B 17/02

See application file for complete search history.

(56) References Cited

U.S. PATENT DOCUMENTS

| | | | | |
|---|---|---|---|---|
| 6,523,623 | B1 * | 2/2003 | Schuh | E21B 7/04 175/45 |
| 7,359,845 | B2 * | 4/2008 | Kelfoun | E21B 7/046 324/303 |
| 7,630,872 | B2 * | 12/2009 | Xia | G01V 1/40 703/10 |
| 9,043,154 | B2 * | 5/2015 | Luxey | E21B 44/00 702/11 |
| 2008/0308272 | A1 * | 12/2008 | Thomeer | E21B 43/00 166/250.15 |

* cited by examiner

*Primary Examiner* — D. Andrews
*Assistant Examiner* — Jonathan Malikasim
(74) *Attorney, Agent, or Firm* — Haynes and Boone, LLP

(57) ABSTRACT

Systems, devices, and methods for producing a three-dimensional visualization of one or more of a drilled wellbore, a bottom hole assembly, a drill bit, a drill plan, and one or more lithology windows is provided for drill steering purposes. A drilling motor with a toolface in communication with a sensor system is provided. A controller in communication with the sensor system is operable to generate a depiction of the drill plan, a depiction of the drilling motor, and one or more lithology windows, and to combine these depictions in a three-dimensional visualization of the down hole environment. This visualization may be used by an operator to steer the drilled wellbore.

16 Claims, 8 Drawing Sheets

DOWNHOLE 3D GEO STEERING VIEWER FOR A DRILLING APPARATUS

TECHNICAL FIELD

The present disclosure is directed to systems, devices, and methods for visualizing a down hole environment during a drilling procedure. More specifically, the present disclosure is directed to systems, devices, and methods for producing a three-dimensional visualization of a drill plan and current drilled wellbore toolface as well as a visualization of surrounding geology for steering a drilling apparatus.

BACKGROUND OF THE DISCLOSURE

At the outset of a drilling operation, drillers typically establish a drilling plan that includes a target location and a drilling path to the target location. Once drilling commences, the bottom hole assembly (BHA) may be directed or "steered" from a vertical drilling path in any number of directions, to follow the proposed drilling plan. For example, to recover an underground hydrocarbon deposit, a drilling plan might include a vertical bore to a point to a side of a reservoir containing the deposit, then a directional or horizontal bore that penetrates the deposit. The operator may then follow the plan by steering the BHA through the vertical and horizontal aspects in accordance with the plan.

In slide drilling implementations, such directional drilling requires accurate orientation of a bent housing of the down hole motor. The bent housing is set on surface to a predetermined angle of bend. The high side of this bend is referred to as the toolface of the BHA. In such slide drilling implementations, rotating the drill string changes the orientation of the bent housing and the BHA, and thus the toolface. To effectively steer the assembly, the operator must first determine the current toolface orientation, such as via a measurement-while-drilling (MWD) apparatus. Thereafter, if the drilling direction needs adjustment, the operator must rotate the drill string to change the toolface orientation.

During drilling, a "survey" identifying locational and directional data of a BHA in a well is obtained at various intervals. Each survey yields a measurement of the inclination angle from vertical and azimuth (or compass heading) of the survey probe in a well (typically 40-50 feet behind the total depth at the time of measurement). In directional wellbores, particularly, the position of the wellbore must be known with reasonable accuracy to ensure the correct steering along the desired or planned wellbore path. The measurements themselves include inclination from vertical and the azimuth of the well bore. In addition to the toolface data, and inclination, and azimuth, the data obtained during each survey may also include hole depth data, pipe rotational data, hook load data, delta pressure data (across the down hole drilling motor), and modeled dogleg severity data, for example. Dogleg severity is a measurement of the total curvature of the wellbore expressed over a standard length, typically 100 feet.

These measurements may be taken at discrete points in the well, and the approximate path of the wellbore may be computed from the data obtained at these discrete points. Conventionally, a standard survey is conducted at each drill pipe connection, at approximately every 95 feet, to obtain an accurate measurement of inclination and azimuth for the new survey position.

Information regarding geology may also be obtained during a drilling operation. In some cases, an operator may have access to geology information about a well from external sources, such as offset geological surveys. However, these sources may be challenging for an operator to interpret without an extensive training or a geology background. Furthermore, geology information from external sources is often general in nature and not well suited to various aspects of an actual drilling operation. External geology data may be especially difficult for an operator to analyze correctly while controlling other aspects of a drilling operation.

As a drilling operation proceeds, the operator must consider the geology information and information from available surveys to follow a drill plan. Often, this requires the operator to perform regular corrections to the drilled wellpath. This typically requires the operator to manipulate the drawworks brake and rotate the rotary table or top drive quill to find the precise combinations of hook load, mud motor differential pressure, and drill string torque, to properly position the toolface. This can be difficult and time consuming. Each adjustment has different effects on the toolface orientation, and each must be considered in combination with other drilling requirements, such as the composition of surrounding formations, to drill the hole. Thus, reorienting the toolface in a wellbore is very complex, labor intensive, and sometimes inaccurate. Furthermore, information required to steer the drilling BHA is generally transmitted to the operator in a textual format in conventional systems. The operator must consider the implications of this textual information, formulate a visual mental impression of the overall orientation of the drilling BHA, and try to formulate a steering plan based on this mental impression, before steering the system. A more efficient, reliable, and intuitive method for steering a BHA and visualizing surrounding geological formations is needed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
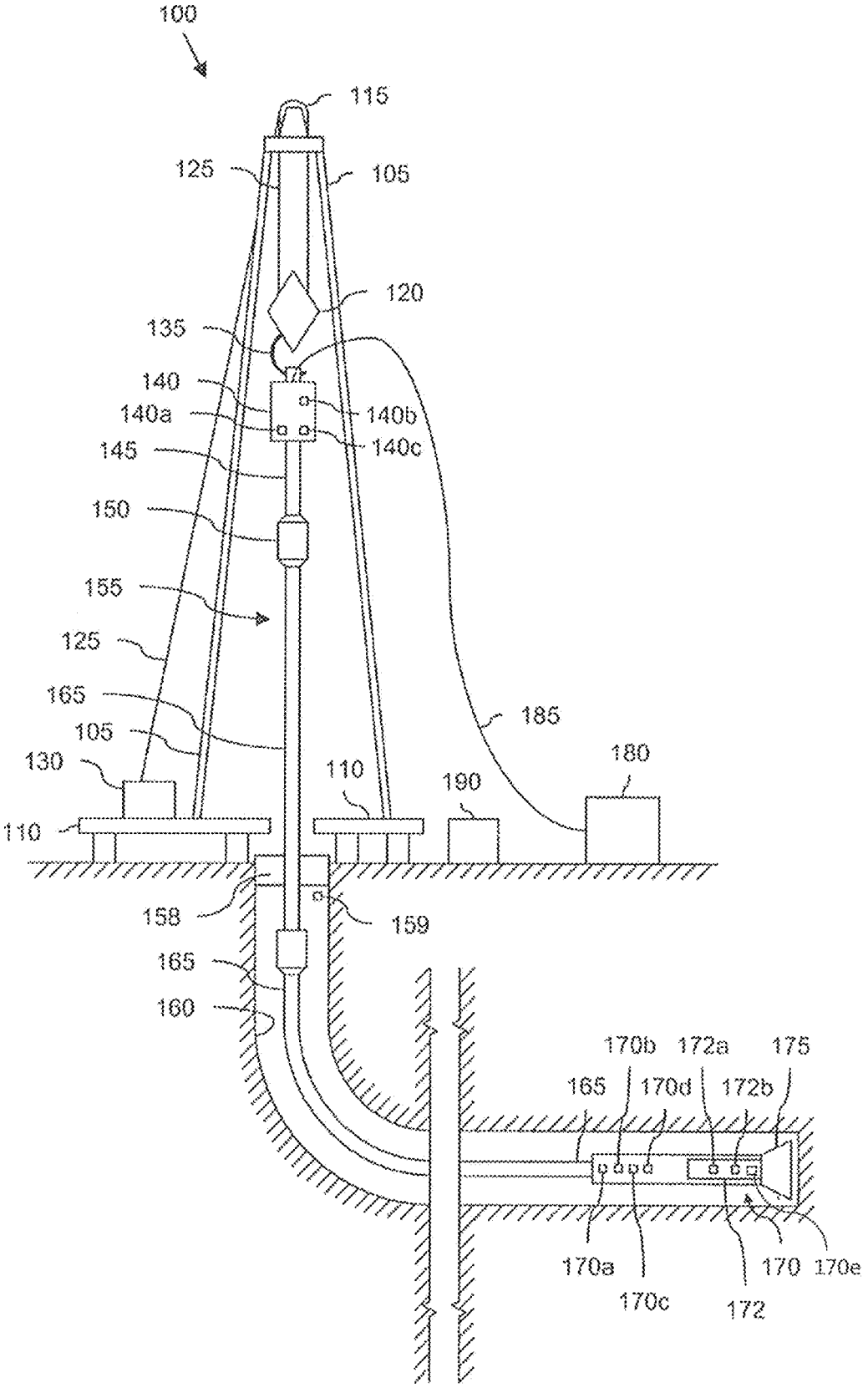
FIG. 1 is a schematic of an exemplary drilling apparatus according to one or more aspects of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

The systems and methods disclosed herein provide intuitive visualizations of geology which may correspond to more intuitive control of BHAs during a drilling procedure. In particular, the present disclosure provides for the creation and implementation of lithology visualizations in a three-dimensional visualization of the down hole environment. The three-dimensional visualization may include windows showing lithology information around the BHA and drill plan, as well as depictions of the location and orientation of the BHA and a drill plan. These depictions may be created from data received from external sources such as geological surveys as well as sensors associated with the drill systems and other input data.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. For the purpose of slide drilling the drill string may include a down hole motor with a bent housing or other bend component, operable to create an off-center departure of the bit from the center line of the wellbore. The direction of this departure in a plane normal to the wellbore is referred to as the toolface angle or toolface. The drill bit 175, which may also be referred to herein as a "tool," or a "toolface," may be connected to the bottom of the BHA 170 or otherwise attached to the drill string 155. One or more pumps 180 may deliver drilling fluid to the drill string 155 through a hose or other conduit, which may be connected to the top drive 140.

The down hole MWD or wireline conveyed instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating blow-out preventer (BOP) 158 that may assist when the well 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. Depending on the implementation, the apparatus 100 may include a down hole annular pressure sensor 170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a* may include both static annular pressure (pumps off) and active annular pressure (pumps on).

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor 170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172.

The apparatus 100 may additionally or alternatively include a toolface sensor 170*c* configured to detect the current toolface orientation. The toolface sensor 170*c* may be or include a conventional or future-developed magnetic toolface sensor which detects toolface orientation relative to magnetic north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170.

The apparatus 100 may additionally or alternatively include a gamma sensor 170*e* configured to measure naturally occurring gamma radiation to characterize nearby rock and sediment. The gamma sensor may be used to generate data for lithology windows as described below. The gamma sensor 170*e* may be disposed in or associated with the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block, drilling line or dead line anchor may additionally or alternatively include or otherwise be associated with a WOB sensor 140*c* (WOB calculated from a hook load sensor that can be based on active and static hook load) (e.g., one or more sensors installed somewhere in the load path mechanisms to detect and calculate WOB, which can vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

Figure 2:
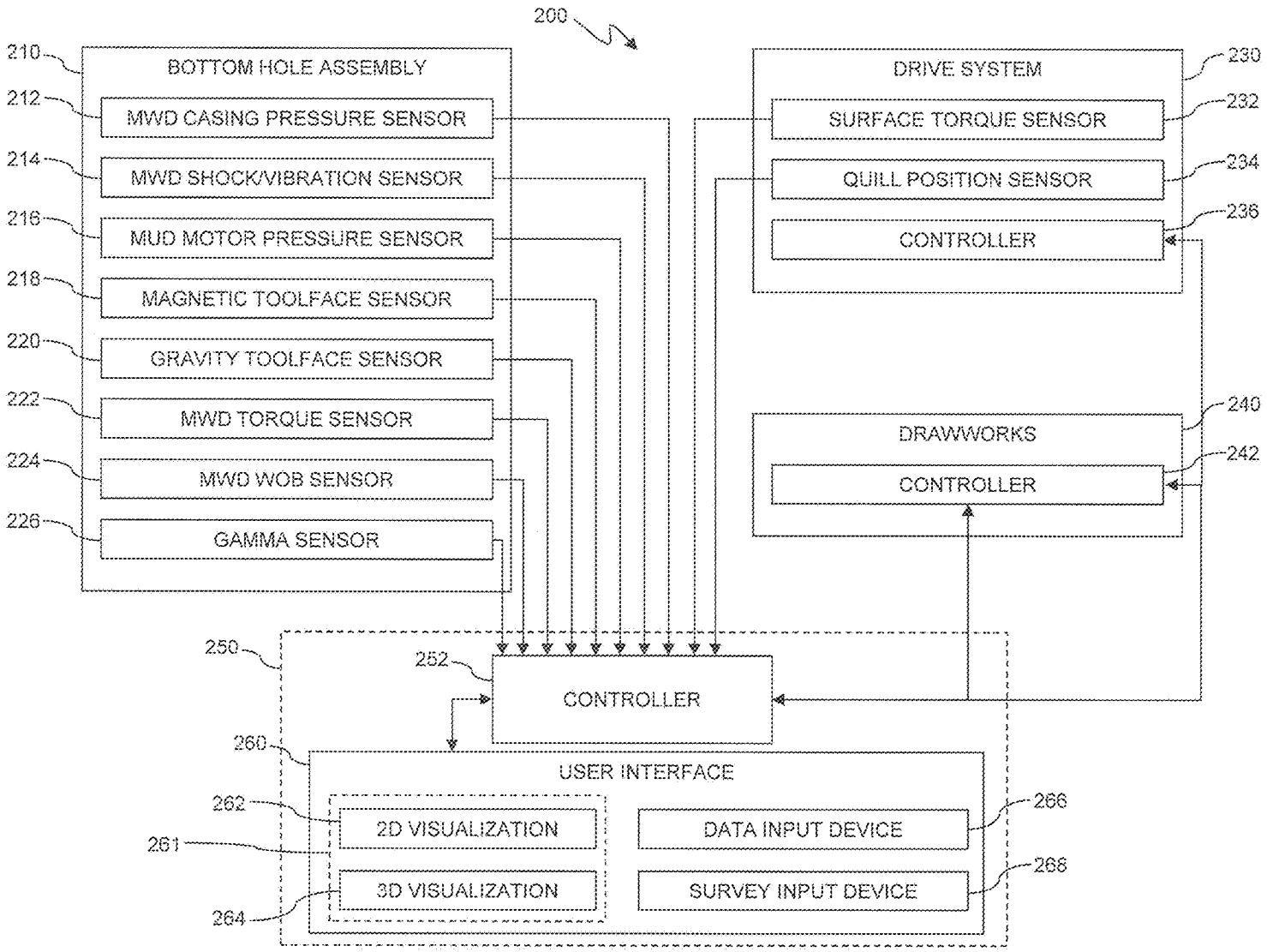
FIG. 2 is a schematic of an exemplary sensor and control system according to one or more aspects of the present disclosure.

Referring to FIG. 2, illustrated is a block diagram of an apparatus 200 according to one or more aspects of the present disclosure. The apparatus 200 includes a user interface 260, a bottom hole assembly (BHA) 210, a drive system 230, a drawworks 240, and a controller 252. The apparatus 200 may be implemented within the environment and/or apparatus shown in FIG. 1. For example, the BHA 210 may be substantially similar to the BHA 170 shown in FIG. 1, the drive system 230 may be substantially similar to the top drive 140 shown in FIG. 1, the drawworks 240 may be substantially similar to the drawworks 130 shown in FIG. 1, and the controller 252 may be substantially similar to the controller 190 shown in FIG. 1.

The user interface 260 and the controller 252 may be discrete components that are interconnected via wired or wireless devices. Alternatively, the user interface 260 and the controller 252 may be integral components of a single system or controller 250, as indicated by the dashed lines in FIG. 2.

The user interface 260 may include data input device 266 for user input of one or more toolface set points, and may also include devices or methods for data input of other set points, limits, and other input data. The data input device 266 may include a keypad, voice-recognition apparatus, dial, button, switch, slide selector, toggle, joystick, mouse, data base and/or other conventional or future-developed data input device. Such data input device 266 may support data input from local and/or remote locations. Alternatively, or additionally, the data input device 266 may include devices for user-selection of predetermined toolface set point values or ranges, such as via one or more drop-down menus. The toolface set point data may also or alternatively be selected by the controller 252 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a survey input device 268. The survey input device 268 may include information gathered from sensors regarding the orientation and location of the BHA 210. In some implementations, information is automatically entered into the survey input device 268 and the user interface at regular intervals.

The user interface 260 may also include a display device 261 arranged to present a two-dimensional visualization 262 and a three-dimensional visualization 264 for visually presenting information to the user in textual, graphic, or video form. In some implementations, the display device 261 is a computer monitor, an LCD or LED display, table, touch screen, or other display device. In some implementations, the two-dimensional visualization 262 and the three-dimensional visualization 264 include one or more depictions. As used herein, a "depiction" is a two-dimensional or three-dimensional graphical representation of an object (such as a BHA) or other data (such as a drill plan or a lithology window) which may be input into the user interface 260. These depictions may be figurative, and may be accompanied by data in a textual format. As used herein, a "visualization" is a two-dimensional or three-dimensional user-viewable representation of one or more depictions. In some implementations, a visualization is a control interface. For example, the two-dimensional visualization 262 may be utilized by the user to view sensor data and input the toolface set point data in conjunction with the data input device 266. The toolface set point data input device 266 may be integral to or otherwise communicably coupled with the two-dimensional visualization 262. In other implementations, a visualization is a representation of an environment from the viewpoint of a simulated camera. This viewpoint may be zoomed in or out, moved, or rotated to view different aspects of one or more depictions. For example, the three-dimensional visualization 264 may show a down hole environment including depictions of the BHA, the drill plan, and one or more lithology windows. Furthermore, the down hole environment may include information from a control interface overlaid on depictions of the BHA and drill plan. The three-dimensional visualization 264 may incorporate information shown on the two-dimensional visualization 262. In some cases, the three-dimensional visualization 264 includes a two-dimensional visualization 262 overlaid on a three-dimensional visualization of the down hole environment which may include a depiction of a drill plan. The two-dimensional visualization 262 and three-dimensional visualization 264 will be discussed in further detail with reference to FIG. 3.

Still with reference to FIG. 2, the BHA 210 may include an MWD casing pressure sensor 212 that is configured to detect an annular pressure value or range at or near the MWD portion of the BHA 210, and that may be substantially similar to the down hole annular pressure sensor 170*a* shown in FIG. 1. The casing pressure data detected via the MWD casing pressure sensor 212 may be sent via electronic signal to the controller 252 via wired or wireless transmission.

The BHA 210 may also include an MWD shock/vibration sensor 214 that is configured to detect shock and/or vibration in the MWD portion of the BHA 210, and that may be substantially similar to the shock/vibration sensor 170*b* shown in FIG. 1. The shock/vibration data detected via the MWD shock/vibration sensor 214 may be sent via electronic signal to the controller 252 via wired or wireless transmission.

The BHA 210 may also include a mud motor pressure sensor 216 that is configured to detect a pressure differential value or range across the mud motor of the BHA 210, and that may be substantially similar to the mud motor pressure sensor 172*a* shown in FIG. 1. The pressure differential data detected via the mud motor pressure sensor 216 may be sent via electronic signal to the controller 252 via wired or wireless transmission. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include a magnetic toolface sensor 218 and a gravity toolface sensor 220 that are cooperatively configured to detect the current toolface, and that collectively may be substantially similar to the toolface sensor 170*c* shown in FIG. 1. The magnetic toolface sensor 218 may be or include a conventional or future-developed magnetic toolface sensor which detects toolface orientation relative to magnetic north. The gravity toolface sensor 220 may be or include a conventional or future-developed gravity toolface sensor which detects toolface orientation relative to the Earth's gravitational field. In an exemplary implementation, the magnetic toolface sensor 218 may detect the current toolface when the end of the wellbore is less than about 7° from vertical, and the gravity toolface sensor 220 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor 218 and/or gravity toolface sensor 220) may be sent via electronic signal to the controller 252 via wired or wireless transmission.

The BHA 210 may also include a MWD torque sensor 222 that is configured to detect a value or range of values for torque applied to the bit by the motor(s) of the BHA 210, and that may be substantially similar to the torque sensor 172*b* shown in FIG. 1. The torque data detected via the MWD torque sensor 222 may be sent via electronic signal to the controller 252 via wired or wireless transmission.

The BHA 210 may also include a MWD WOB sensor 224 that is configured to detect a value or range of values for WOB at or near the BHA 210, and that may be substantially similar to the WOB sensor 170*d* shown in FIG. 1. The WOB data detected via the MWD WOB sensor 224 may be sent via electronic signal to the controller 252 via wired or wireless transmission.

The BHA 226 may also include a lithology sensor. The lithology sensor may be any type of sensor to determine the location and/or composition of geologic formations around a drilling operation. In some implementations, the lithology sensor is a gamma sensor 226 that is configured to assist an operator in gathering lithology data from the formations around the BHA. In some embodiments, the gamma sensor 226 is configured to measure naturally occurring gamma radiation to characterize nearby rock and sediment, and may be substantially similar to the gamma sensor 170*e* shown in FIG. 1. In some embodiments, the gamma sensor 226 produces a simple gamma count of gamma rays incident on the gamma sensor 226. In other embodiments, the gamma sensor 226 is configured to measure a direction associated with a gamma count. This type of gamma sensor 226 may be referred to as an azimuthal gamma sensor and may be particularly useful in gathering lithology information for directional drilling applications. In some embodiments, an azimuthal gamma sensor may produce a list of gamma counts taken at different times and positions, wherein each gamma count corresponds to an angular measurement of the gamma sensor.

The drawworks 240 may include a controller 242 and/or other devices for controlling feed-out and/or feed-in of a drilling line (such as the drilling line 125 shown in FIG. 1). Such control may include rotational control of the drawworks (in v. out) to control the height or position of the hook, and may also include control of the rate the hook ascends or descends.

The drive system 230 may include a surface torque sensor 232 that is configured to detect a value or range of the reactive torsion of the quill or drill string, much the same as the torque sensor 140*a* shown in FIG. 1. The drive system 230 also includes a quill position sensor 234 that is configured to detect a value or range of the rotational position of the quill, such as relative to true north or another stationary reference. The surface torsion and quill position data detected via the surface torque sensor 232 and the quill position sensor 234, respectively, may be sent via electronic signal to the controller 252 via wired or wireless transmission. The drive system 230 also includes a controller 236 and/or other devices for controlling the rotational position, speed, and direction of the quill or other drill string component coupled to the drive system 230 (such as the quill 145 shown in FIG. 1).

The controller 252 may be configured to receive one or more of the above-described parameters from the user interface 260, the BHA 210, the drawworks 240, and/or the drive system 230, and utilize such parameters to continuously, periodically, or otherwise determine the current toolface orientation. The controller 252 may be further configured to generate a control signal, such as via intelligent adaptive control, and provide the control signal to the drive system 230 and/or the drawworks 240 to adjust and/or maintain the toolface orientation. For example, the controller 252 may provide one or more signals to the drive system 230 and/or the drawworks 240 to increase or decrease WOB and/or quill position, such as may be required to accurately "steer" the drilling operation.

The HMI 300 is used by a user, who may be an operator at a drilling operation, such as a directional driller, while drilling to monitor the BHA in three-dimensional space. The controller 252 of FIG. 2 may drive one or more other human-machine interfaces during drilling operation may be configured to also display the HMI 300. The controller 252 driving the HMI 300 may include a "survey" or other data channel, or otherwise includes devices for receiving and/or reading sensor data relayed from the BHA 170, a measurement-while-drilling (MWD) assembly, and/or other drilling parameter measurement devices, where such relay may be via the Wellsite Information Transfer Standard (WITS), WITS Markup Language (WITS ML), and/or another data transfer protocol. Such electronic data may include gravity-based toolface orientation data, magnetic-based toolface orientation data, azimuth toolface orientation data, and/or inclination toolface orientation data, among others.

Figure 3:
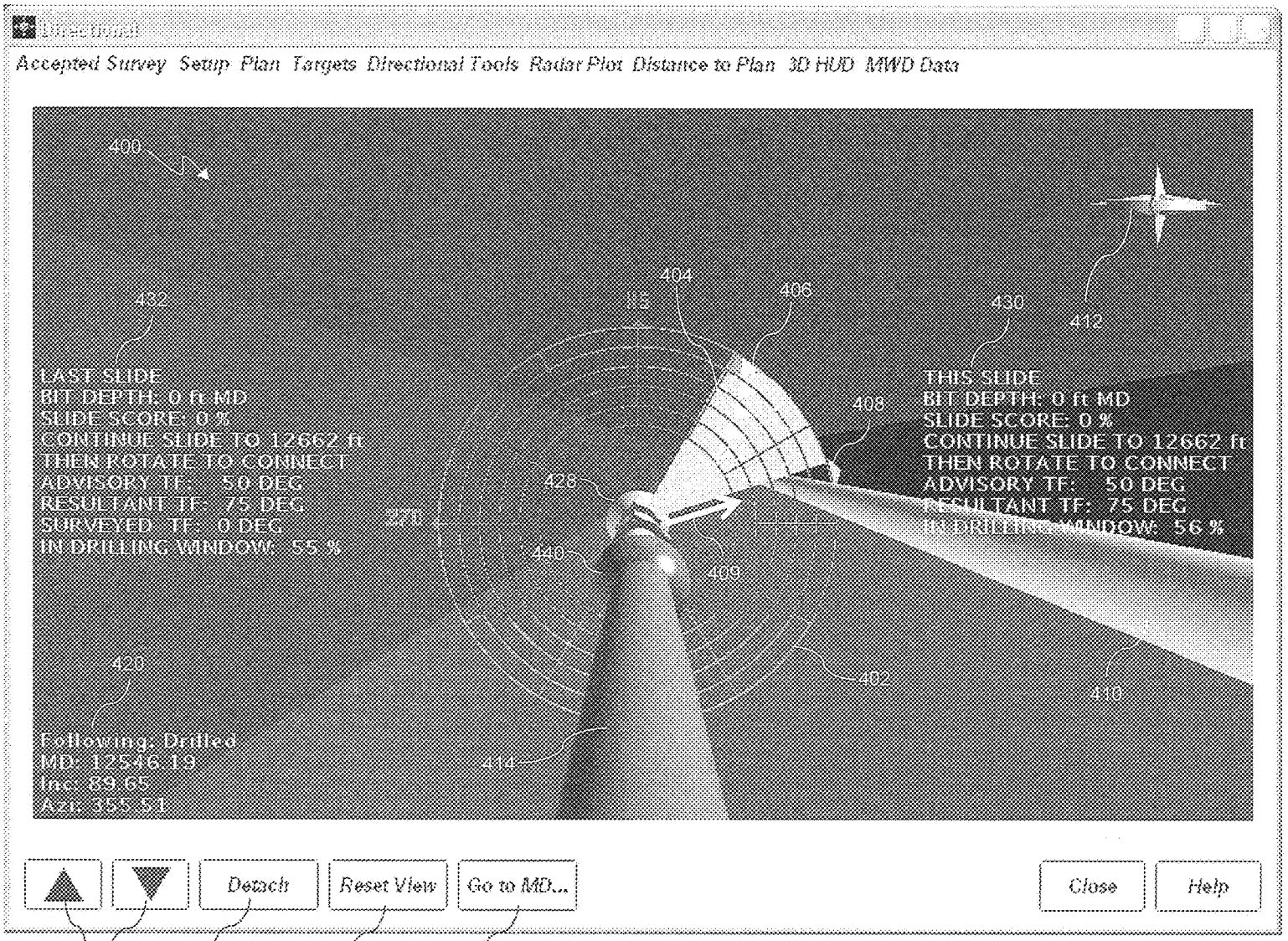
FIG. 3 is a representation of an exemplary display and control apparatus showing a three-dimensional visualization according to one or more aspects of the present disclosure.

FIG. 3 is an exemplary representation of an HMI 400 configured to relay information about the toolface location and orientation to a user on the display device 261 of FIG. 2. This display may be the three-dimensional visualization 264 of FIG. 2. In the example of FIG. 3, the HMI 400 includes three-dimensional depictions of a drill plan 410, a drilling motor and drilling bit 428, and a drilled wellbore 414, as well as two-dimensional depictions. The HMI 400 may be used by an operator to gain an intuitive view of the BHA and drill plan. In some implementations, the HMI 400 shows a "camera view" of the down hole environment, or the view that a simulated camera would show if imaging aspects of the down hole environment. In particular, the depiction of the drill plan 410 may appear as a long, cylindrical string extending through the down hole environment. The depiction of the drill plan 410 may be created in the three-dimensional display based on data of a desired drill plan entered or otherwise uploaded by the user. The depiction of the toolface angle at the drilling bit 428 appears as symbols 406 on the concentric circular grid 402 in the example of FIG. 3. This depiction shows the last recorded or measured location of the toolface and may include information about its orientation. In one implementation, data concerning the location and orientation of the drilling bit 428 are shown in index 420. In the example of FIG. 3, the index 420 indicates that the most recent depth of the drilling bit 428 was measured at 12546.19 feet, the inclination was 89.65°, and the azimuth was 355.51°. In some instances, the depiction of the drilling bit 428 is centered in the HMI 400, as shown in FIG. 3. In other implementations, index 420 contains data about the location and orientation of the simulated camera whose view is depicted in HMI 400.

A three-dimensional compass 412 shows the orientation of the present view of the HMI 400, and is an indication of an x-y-z coordinate system. The depiction of the drilled wellbore 414 extends outward from the depiction of the drilling bit 428. In some cases, the drilled wellbore 414 can depict the location of the drill string along with previous measurements of the location and orientation of the toolface.

One or more stations 440 may be depicted along the drilled wellbore 414 or drill plan 410. These stations 440 may represent planned or actual locations for events during a drilling operation. For example, the stations 440 may show the location of previous surveys taken during the drilling process. In some cases, these surveys are taken at regular intervals along the wellbore. Furthermore, real-time measurements are made ahead of the last standard survey, and can give the user feedback on the progress and effectiveness of a slide or rotation procedure. These measurements may be used to update aspects of the visualization such as the drilled wellbore 414 and concentric circular grid 402, advisory segment 404, symbols 406, and indicator 408. In other embodiments, the stations 440 represent a position selected by a user. As will be discussed below, the stations 440 may represent sections of the drill plan 410 or drilled wellbore 414 corresponding to lithology windows.

In the example of FIG. 3, the concentric circular grid 402, advisory segment 404, symbols 406, and indicator 408 are overlaid on the three-dimensional visualization. In the example of FIG. 3, the concentric circular grid 402, advisory segment 404, symbols 406, and indicator 408 are centered on the depiction of the drilling bit 428. In some implementations, indicator 408 may be alternatively depicted as a vector arrow 409. In either case, the indicator 408 and/or vector arrow 409 may indicate a recommended steering path.

Still referring to FIG. 3, index 430 shows data from the most recent movement of the drilling bit and toolface. Index 430 may include a current drilling bit depth measurement, a slide score, suggested corrective actions to align the BHA with the drill plan, and advisory measurements. In some implementations, the HMI 400 may be used to provide feedback to a user in steering accuracy. The effectiveness of steering the actual toolface may be judged by a slide score.

Index 432 shows data from past movements of the toolface. In the example of FIG. 3, index 432 includes data from the last most recent section of the toolface steering, or sliding. Index 432 may contain similar data to that of 430. In some cases, indexes 430 and 432 allow the user to track the movement of the drilling motor as it is steered through the down hole environment.

HMI 400 also includes functions to adjust the three-dimensional view of the HMI 400. In particular, functions 422, 424, 426, and 434 allow a user to reorient the HMI 400 to view different aspects of the toolface or drill plan. In the example of FIG. 3, the view of the HMI 400 is centered on the drilled wellbore 414 with the depiction of the drilling bit 428 at the center. Function 422 removes the view of the HMI 400 from the drilled wellbore 414, which may be represented as "detaching" the simulated camera from the drilled wellbore 414 (or alternatively, the drill string). Function 424 resets the view of the HMI 400 to the view depicted in FIG. 3 with the display centered on the drilled wellbore 414. Function 426 reorients the view of HMI 400 to the bottom of the drilled wellbore 414 with the depiction of the drilling bit 428 in the center. Function 434, which includes arrow symbols, may be used to reorient the view of the HMI 400 to different positions along the drilled wellbore 414. In some implementations, function 434 allows a user to travel up and down a depiction of the previous locations of the toolface and/or a depiction of the drill string.

Figure 4:
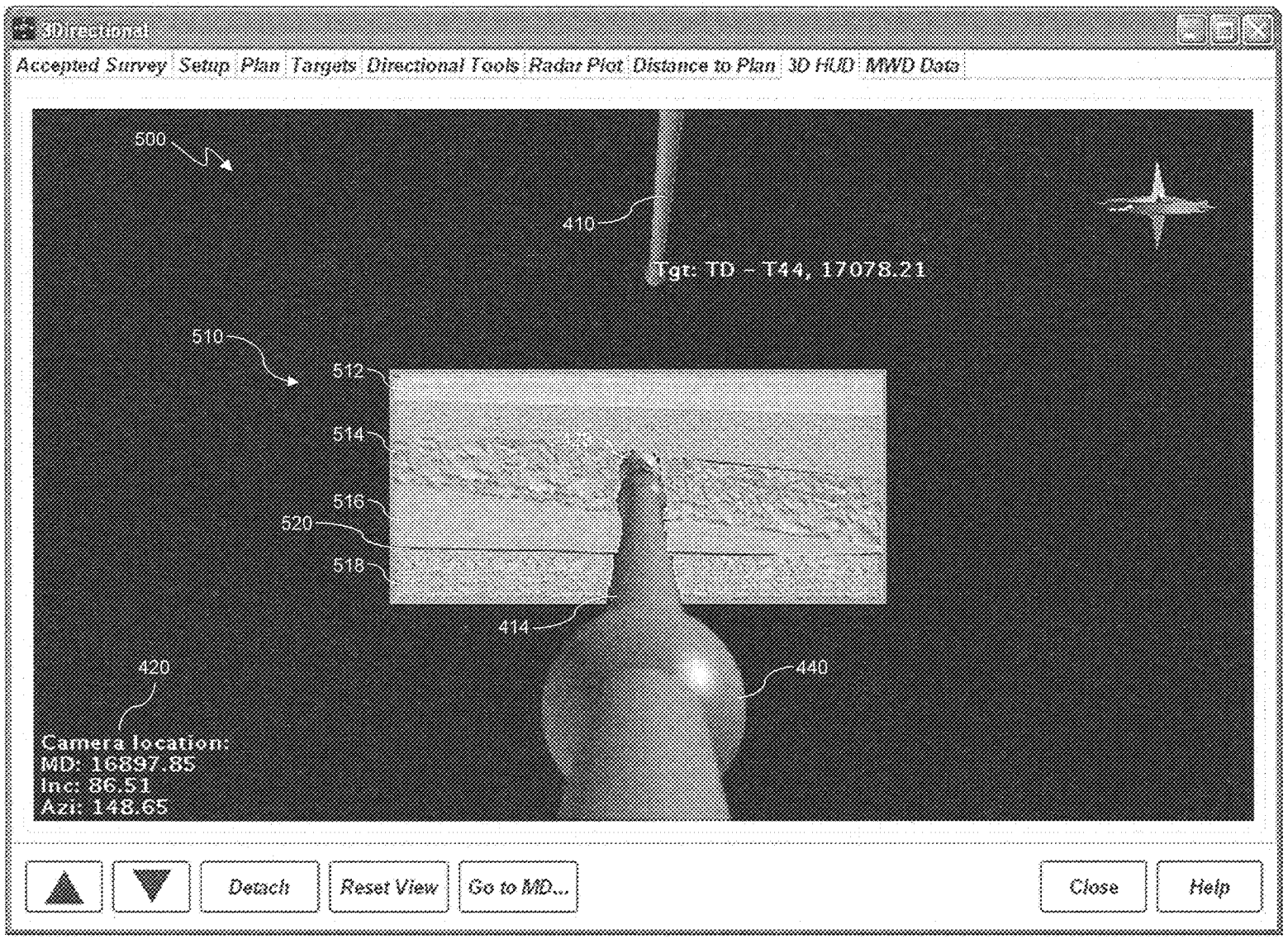
FIG. 4 is a representation of an exemplary display and control apparatus showing a three-dimensional visualization with a lithology window according to one or more aspects of the present disclosure.
Figure 5:
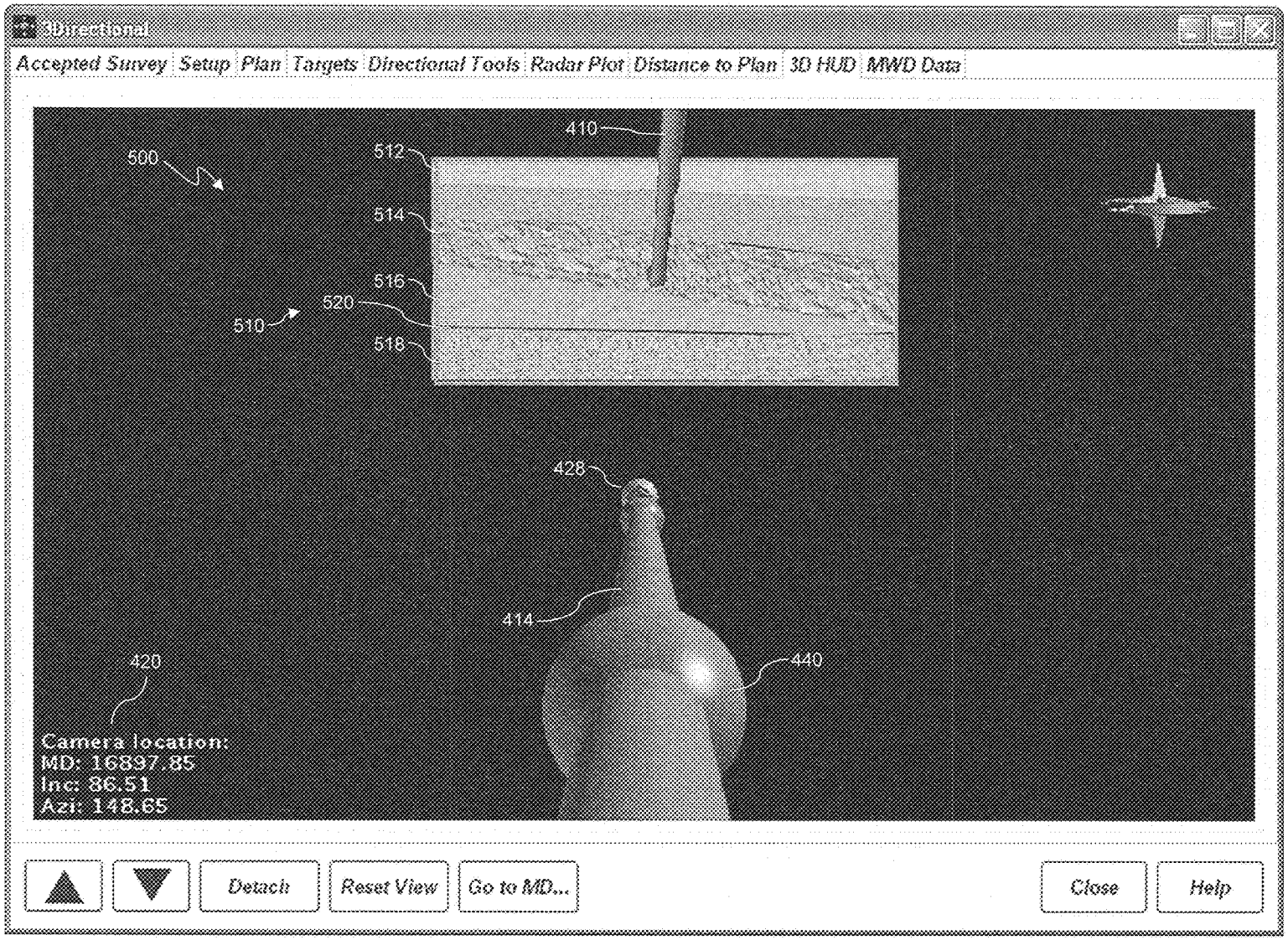
FIG. 5 is a representation of an exemplary display and control apparatus showing another three-dimensional visualization with a lithology window according to one or more aspects of the present disclosure.
Figure 6:
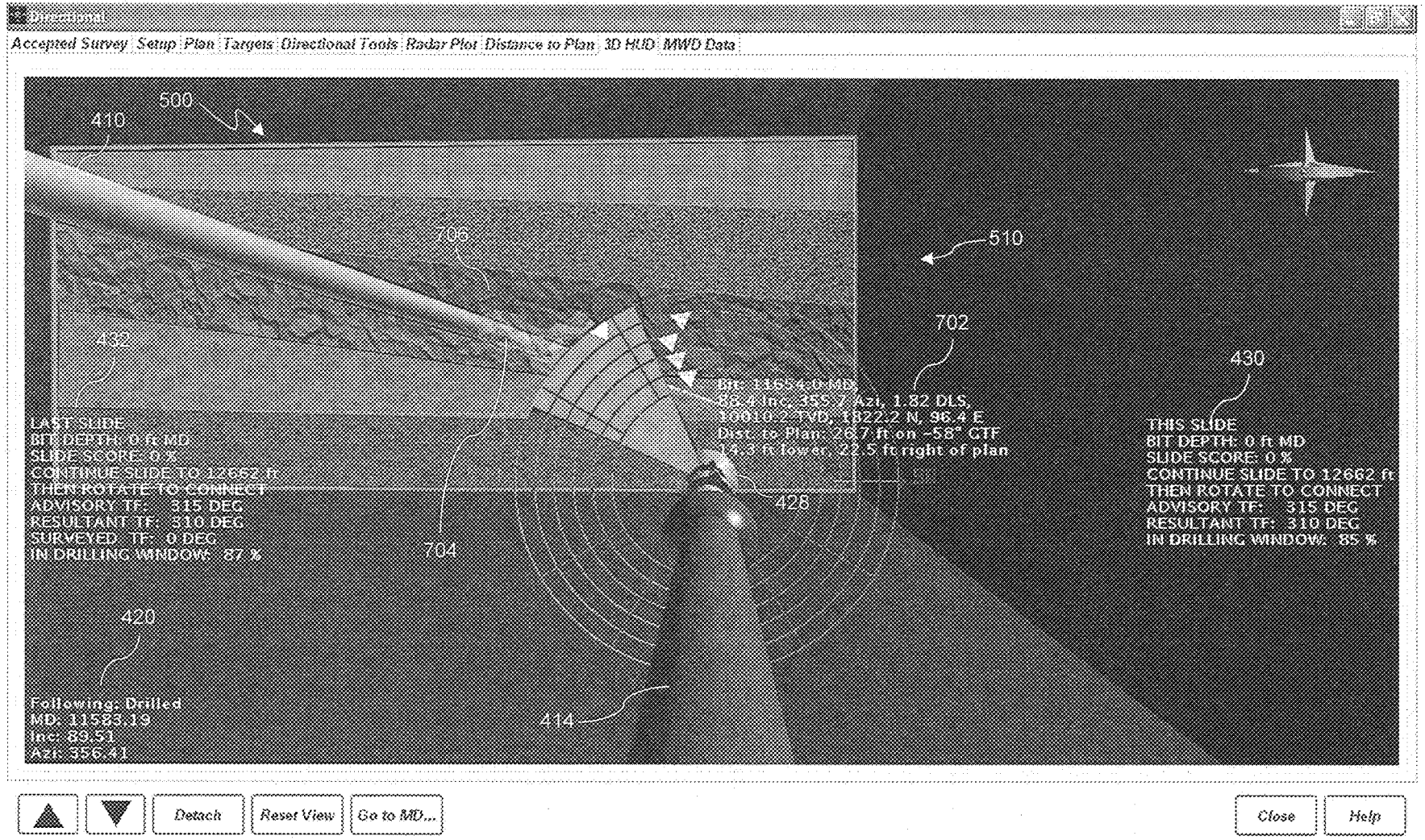
FIG. 6 is a representation of an exemplary display and control apparatus showing another three-dimensional visualization with a lithology window according to one or more aspects of the present disclosure.

FIGS. 4-6 show lithology windows 510 that may be displayed on a three-dimensional HMI 500. In some embodiments, the HMI 500 may include one or more, including all of the aspects of the HMI 400 shown in FIG. 3. For example, the HMI 500 may include three-dimensional depictions of a drill plan 410 and a drilled wellbore 414. The drilled wellbore 414 may extend back from a depiction of a drilling bit 428 and may include a number of stations 440 (shown as spheres) showing survey locations. The HMI 500 may also include an index 420 showing position of the drilling bit 428, or in the example of FIG. 5, the position of the simulated camera.

The HMI 500 may include one or more lithology windows 510. These lithology windows 510 may depict the presence and composition of formations around the drill plan 410 or drilled wellbore 414. In the example of FIG. 4, a lithology window 510 is placed at a position along the drilled wellbore 414, while in FIG. 5, a lithology window 510 is placed at a position along the drill plan 410. In FIG. 6, a lithology window 510 includes data corresponding to both the drill plan 410 and drilled wellbore 414. In some embodiments, more than one lithology window 510 may be shown in a display. For example, lithology windows 510 corresponding to both the drill plan 410 and the drilled wellbore 414 may be included, or two or more lithology windows 510 may be displayed showing aspects of the lithology around the drill plan 410 and drilled wellbore 414. In some embodiments, the lithology windows 510 may be displayed parallel or normal to a drill plan 410 or drilled wellbore 414 depiction. The lithology windows 510 may also be offset from the drill plan 410 or drilled wellbore 414 depictions. The lithology windows 510 may be available for selected sections of the drill plan 410 or drilled wellbore 414 (such as being positioned at a station 440), or over the complete length of either the drill plan 410 or the drilled wellbore 414. For example, a user may select any point along the length of a drilled wellbore 414 to view a lithology window 510 showing formation information related to the selected point. As indicated previously, these may be generated based on geological devices or sensors, such as a gamma sensor.

In some embodiments, lithology windows 510 are displayed in relation to a station 440. In this case, the lithology window 510 may display information corresponding to the position of the station 440 along the drilled wellbore 414 or drill plan 410. In some embodiments, the lithology window 510 intersects a section of the drill plan 410 and the drilled wellbore 414 at respective stations 440, such as in the example of FIG. 6. This setup may allow user to compare positions of the drill plan 410 and drilled wellbore 414 side by side, as well as their respective lithological information.

In some embodiments, the lithology windows 510 may include transparent or overlaid regions, similar to the concentric circular grid 402 shown in FIG. 3. For example, a lithology window 510 may be placed over the depiction of the BHA 428, thus allowing a user to see lithological information while still allowing a user to view the position of the BHA 428. The lithological windows 510 may be designed to be immersive. For example, a user may be able to change the angle of the virtual camera to access different views of the lithology window 510.

The inclusion of lithology windows 510 in the HMI 500 may provide an intuitive view of geological formations for a user, which in turn may help in analyzing the progress of a the drilling operation and making quicker and more accurate steering decisions. The lithology windows 510 may be included in the HMI 500 as a separate visual window placed nearby or connected to the drill plan 410, drilled wellbore, or drill history.

In some embodiments, the lithology windows 510 include representations of various formation layers 512, 514, 516, 518, and transition zones 520 between layers. The composition of various layers 512, 514, 516, 518 and transition zones 520 may be displayed visually through the use of colors and textures as shown in the example of FIG. 4, as well as other symbols. Textual information about the composition of layers 512, 514, 516, 518 and transition zones 520 may also be displayed on the lithology windows 510 or on other areas of the HMI 500, such as a separate index. A user may be able to expand various aspects of the lithology windows 150 or "zoom in" on various features. For example, a lithology window 510 may include a zoom button that a user can press to enlarge a given area of the lithology window 510 to show greater detail.

In some embodiments, the lithology windows 510 are generated using data from sensors on the drilling rig 100. For example, a lithology sensor may be positioned on a BHA of the drilling rig 100. This lithology sensor may be any type of sensor for detecting and/or identifying geologic formations. In some implementations, the lithology sensor is a gamma sensor, such as gamma sensor 226 shown in FIG. 2. This gamma sensor 226, which may be a conventional gamma sensor or an azimuthal gamma sensor as described above, may be configured to receive gamma count readings from the environment around the BHA during a drilling operation. The gamma count readings may be used to generate formation information which in turn may be used to generate the layers 512, 514, 516, 518 and transition zones 520 shown on a lithology window. For example, a gamma sensor 226 positioned on a BHA may receive various gamma counts as the BHA travels down hole along the drill path. The gamma sensor 226 may detect a high gamma count over a short section of the drill path, which may correspond to a shale layer. The gamma sensor 226 may then detect a decreasing gamma count over several feet, which may correspond to a transition zone 520. The gamma sensor 226 may then detect a low gamma count over a short section of the drill path, corresponding to a layer of sandstone. Information gathered by the gamma sensor 226 may be transmitted to a controller which in turn generates a lithology window 510 positioned at the segment of the drill string corresponding to the readings which includes a representation of the shale layer, the transition zone, and the sandstone layer. Any discrepancies between the lithology indicating sensor data and the lithology window may be easily identified and may be directed to geo-steering personnel.

In some embodiments, the actual data readings (such as the gamma count) of the gamma sensor 226 or other down hole logging device may be displayed along the length of the depictions of the drill plan 410 and/or drilled wellbore 414. These data readings may be represented by varying coloration, textures, or by a two- or three-dimensional histogram or other symbolic displays. The various colors and textures may also be displayed on the depictions of the drill plan 410 or drilled wellbore 414 themselves. For example, the exterior surface of the drill plan 410 or drilled wellbore 414 may be colored or textured in sections with boundaries corresponding to formation boundaries around the drill plan 410 or drilled wellbore 414. This may provide for the "embedding" of lithological data in the depictions of the drill plan 410 or drilled wellbore 414. Data readings may also be displayed at the top of the drill plan 410 or drilled wellbore 414 or along the length of the drill plan 410 and the drilled wellbore 414.

In some embodiments, lithology windows 510 may be used in an HMI 500 to compare or verify lithological information. For example, a first lithology window 510 is displayed corresponding to a position on the drilled wellbore 414 and a second lithology window 510 is displayed corresponding to a position on the drill plan 410. The first lithology window 510 is populated with information received by a down hole logging device, such as gamma sensor 226 shown in FIG. 2, while the second lithology window 510 is populated with information from an external source such as a geological survey produced by an outside company. The first and second lithology windows 510 may be compared to validate the down hole logging device or the external source. The comparison may include a simple visual comparison of the layers, such as identifying and highlighting discrepancies between the windows. The comparison may be used to produce a third lithology window 510 including verified data. Additionally, the comparison may include specific comparisons between the datasets used to populate the first and second lithology windows 510, such as comparisons of the gamma counts at various locations. In some embodiments, if discrepancies are found, the system may be configured to download updated geology information. For example, if the external source is found to be inaccurate, the system may be configured to import an updated earth model to correlate with the formation boundaries detected by the down hole gamma probe.

FIG. 6 is an exemplary representation of an HMI 500 which includes a lithology window 510 corresponding to both a section of a drill plan 410 and a section of a drilled wellbore 414. The HMI 500 may also include an index 702 with information about the position of the BHA in relation to the drill plan 410.

The lithology window 510 of FIG. 6 includes transparent features, such as region 704. These transparent features may allow a user to see lithology information and the underlying drill plan 410 at the same time. The edge of the transparent region 704 may represent where the lithology window 510 and the drill plan 410 intersect. This may help a user to more easily determine the correlation between the displayed lithology formations and the drill plan 410. For example, the lithology window 510 of FIG. 6 shows that the drill plan 410 is embedded in a formation 706. Thus, the transparent aspects of the lithology window 510 may provide an intuitive visualization the BHA and surrounding formations.

Figure 7:
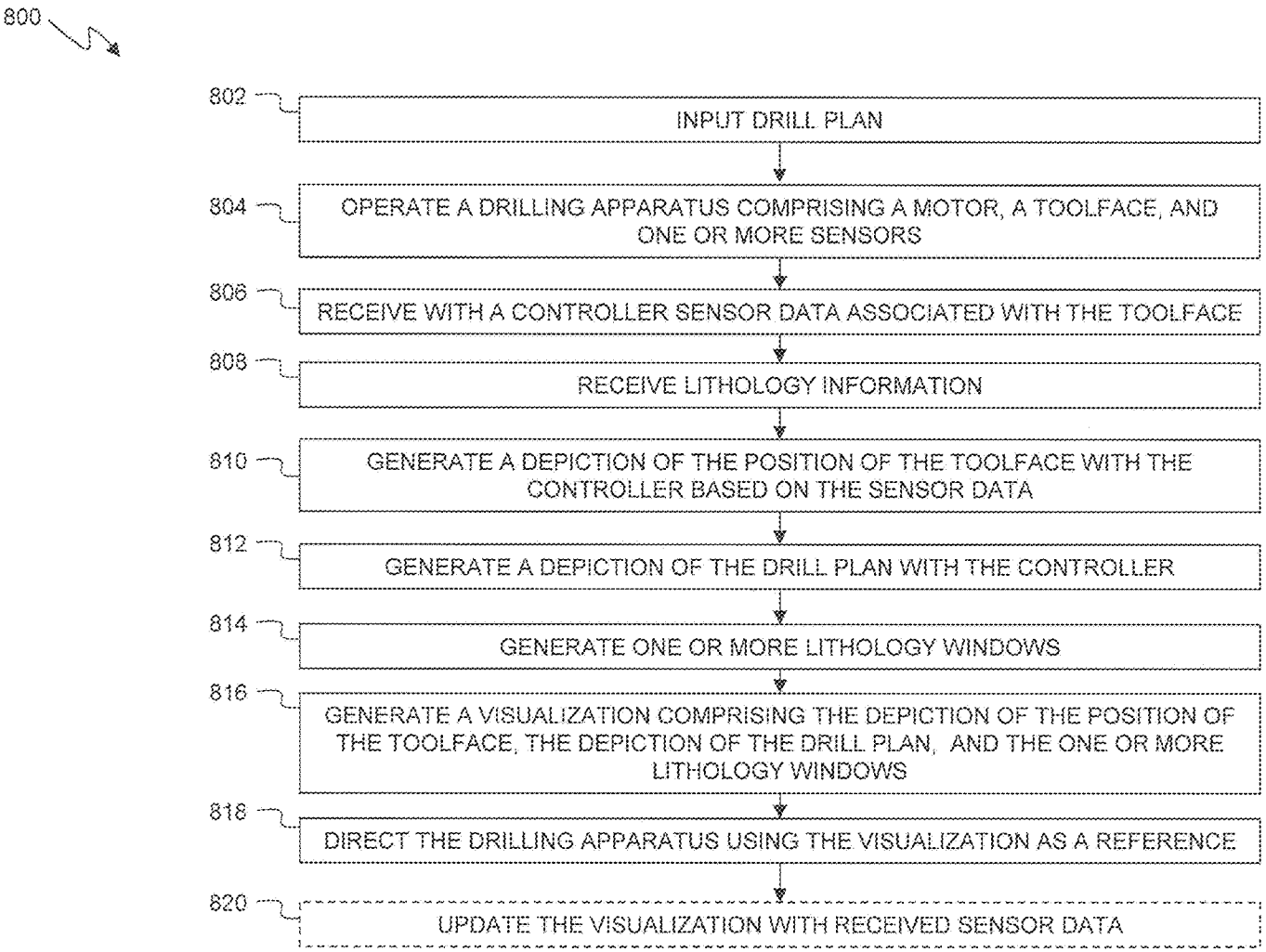
FIG. 7 is a flowchart diagram of a method of steering a drill according to one or more aspects of the present disclosure.

FIG. 7 is a flow chart showing a method 800 of steering a BHA in a down hole environment. It is understood that additional steps can be provided before, during, and after the steps of method 800, and that some of the steps described can be replaced or eliminated for other implementations of the method 800. In particular, any of the control systems disclosed herein, including those of FIGS. 1 and 2, and the displays of FIGS. 3-6, may be used to carry out the method 800.

At step 802, the method 800 may include inputting a drill plan. This may be accomplished by entering location and orientation coordinates into the controller 252 discussed with reference to FIG. 2. The drill plan may also be entered via the user interface, and/or downloaded or transferred to controller 252. The controller 252 may therefore receive the drill plan directly from the user interface or a network or disk transfer.

At step 804, the method 800 may include operating a drilling apparatus comprising a motor, a toolface, and one or more sensors. In some implementations, this drilling apparatus is apparatus 100 discussed in reference to FIG. 1. The drilling apparatus may be operated by an operator who inputs commands in a user interface that is connected to the drilling apparatus. The operation may include drilling a hole to advance the BHA through a subterranean formation.

At step 806, the method 800 may include receiving with a controller sensor data associated with the toolface. This sensor data can originate with sensors located near the toolface in a down hole location, well as sensors located along the drill string or on the drill rig. In some implementations, a combination of controllers, such as those in FIG. 2, receive sensor data from a number of sensors via electronic communication. The controllers then transmit the data to a central location for processing.

At step 808, the method 800 may include receiving lithology information. This information may be received by the controllers from one or more lithology sensors, such as gamma sensors, which may be positioned down hole. Additionally, lithology information may be received by the system from external sources, such as geologic surveys performed by a third party. The lithology information may be transmitted to a central location for processing.

At step 810, the method 800 may include generating a depiction of the position of the toolface with the controller based on the sensor data. This depiction may be accompanied with associated positional data that is displayed in a textual format.

At step 812, the method 800 may include generating a depiction of the drill plan with the controller. This depiction may be a three-dimensional depiction of the drill plan 410 such as that shown in FIGS. 3-6. The depiction can also be a three-dimensional depiction of the actual drill path (referenced as the drilled wellbore) to visually indicate to a user any deviation in distance or direction to the drill plan. The depiction may also include a depiction of the route along a BHA has traveled, referred to as a drill history.

At step 814, the method 800 may include generating one or more lithology windows. The one or more lithology windows may be the lithology windows 510 as shown in FIGS. 4-6. In some embodiments, the lithology windows include information about formations around the toolface, the drilled wellbore, or the drill plan of a drilling operation. The lithology window may include information gathered from gamma sensors as well as from external sources such as geology surveys.

At step 816, the method 800 may include generating a visualization comprising the depiction of the position of the toolface, the depiction of the drill plan, and the one or more lithology windows. This visualization can appear as a simulated camera view such as that shown in HMI 500 in FIGS. 4-6. The position of the toolface may also include earlier positions of the toolface such that a drilled wellbore or drill history is displayed in the visualization. In some implementations, lithology windows may be displayed intersecting or adjacent to the position of the toolface and/or the drill plan. In some implementations, the method can further include generating visualizations to show variation between the position of the toolface and the depiction of the drill plan. In particular, indicators (such as the advisory segment 404 and indicator 408 shown in FIG. 3) may be included in the visualizations to indicate a recommended steering path for moving the toolface and thus the drilling motor toward the drilling plan. The visualization may be controlled by a user in various ways. For example, a user can view lithology data associated with various times during the drilling operation by moving the lithology windows to a given position along the drill plan or drilled wellbore. Furthermore, a user may "detach" the simulated camera from the drilled wellbore and view the drill plan and the lithology windows from various angles.

At step 818, the method 800 may include directing the drilling apparatus using the three-dimensional visualization as a reference. In some cases, the visualization includes aspects of the three-dimensional display of FIG. 4. This display may be included on the same device and a user may be able to access information about the location and orientation of the toolface using the display. The use of the display may be helpful in creating a more general, intuitive view of the down hole environment while providing more specific data concerning important aspects of the toolface where needed.

At step 820, the method 800 may optionally include updating the visualization with received sensor data. In some implementations, the visualization is updated with sensor data from surveys that are conducted at regular intervals along the route of the toolface. The visualization may also be updated at regular time intervals according received sensor data, such as every five or ten seconds, for example. In some cases, a two-dimensional overlay such as the concentric circular grid 402 and concentric rings shown in FIG. 3 is updated with time-dependent sensor data. Furthermore, the visualization may be updated with comparisons of the lithological information presented in the lithology windows.

In an exemplary implementation within the scope of the present disclosure, the method 800 repeats after step 818 or 820, such that method flow goes back to step 804 and begins again. Iteration of the method 800 may be utilized to characterize the performance of toolface control. Moreover, iteration may allow some aspects of the visualization to be refined each time a survey is received. For example, the advisory width and direction may be refined to give a better projection to be used in steering the toolface.

Figure 8:
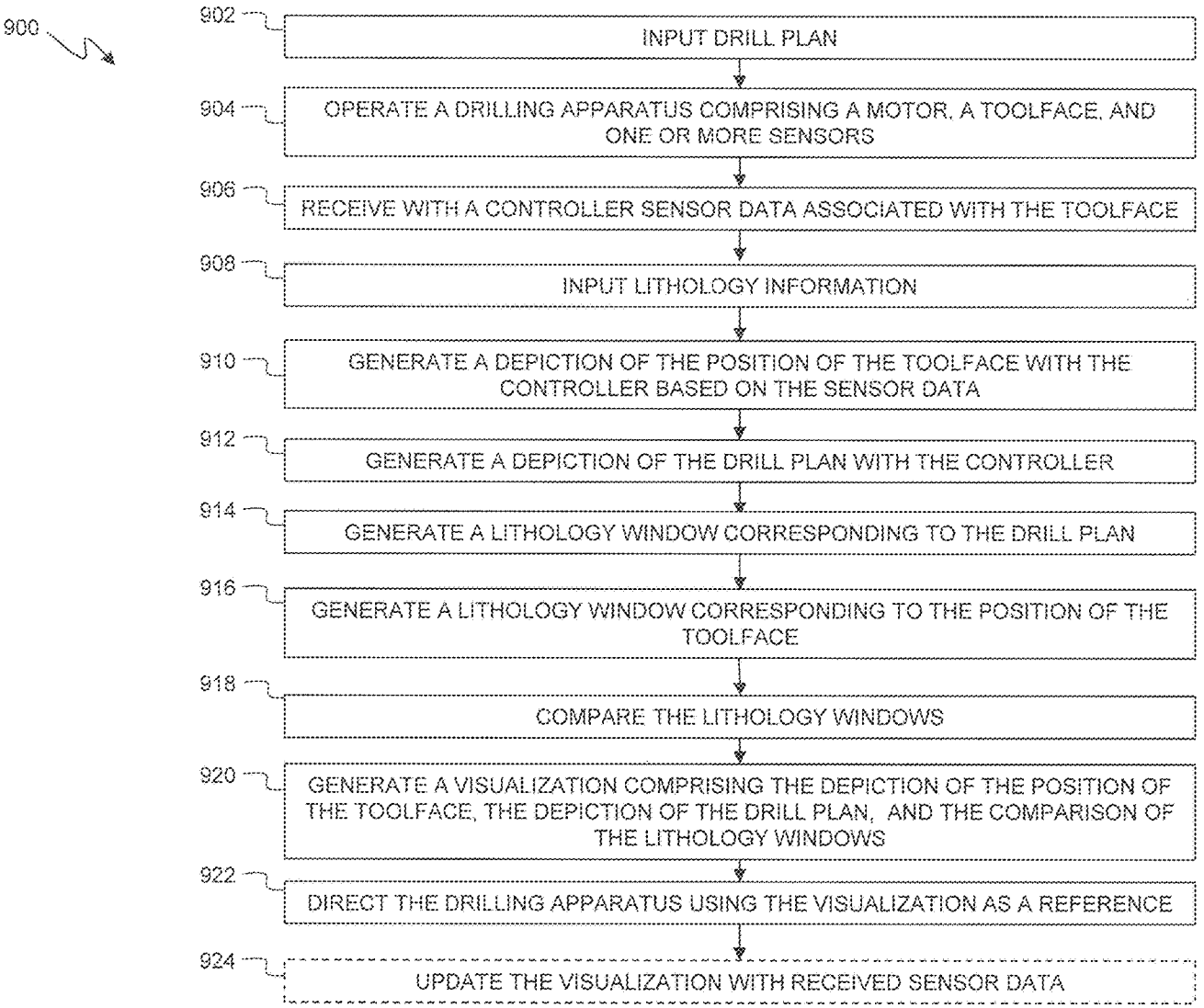
FIG. 8 is a flowchart diagram of another method of steering a drill according to one or more aspects of the present disclosure.

FIG. 8 is a flow chart showing a method 900 of steering a BHA in a down hole environment. In particular, method 900 may include comparison of lithology data from two or more sources during a drilling operation. It is understood that additional steps can be provided before, during, and after the steps of method 900, and that some of the steps described can be replaced or eliminated for other implementations of the method 900. In particular, any of the control systems disclosed herein, including those of FIGS. 1 and 2, and the displays of FIGS. 3-6, may be used to carry out the method 900.

At step 902, the method 900 may include inputting a drill plan. This may be accomplished by entering location and orientation coordinates into the controller 252 discussed in reference to FIG. 2. The drill plan may also be entered via the user interface, and/or downloaded or transferred to controller 252. The controller 252 may therefore receive the drill plan directly from the user interface or a network or disk transfer.

At step 904, the method 900 may include operating a drilling apparatus comprising a motor, a toolface, and one or more sensors. In some implementations, this drilling apparatus is apparatus 100 discussed in relation to FIG. 1. The drilling apparatus may be operated by an operator who inputs commands in a user interface that is connected to the drilling apparatus. The operation may include drilling a hole to advance the BHA through a subterranean formation.

At step 906, the method 900 may include receiving with a controller sensor data associated with the toolface. This sensor data can originate with sensors located near the toolface in a down hole location, well as sensors located along the drill string or on the drill rig. In some implementations, a combination of controllers, such as those in FIG. 2, receive sensor data from a number of sensors via electronic communication. The controllers then transmit the data to a central location for processing.

At step 908, the method 900 may include receiving lithology information. This information may be received by the controllers from one or more lithology sensors, such as gamma sensors positioned down hole, as well as from external sources, such as geologic surveys performed by a third party. The lithology information may be transmitted to a central location for processing. In some embodiments, two or more sources of lithology information are received by the controllers.

At step 910, the method 900 may include generating a depiction of the position of the toolface with the controller based on the sensor data. This depiction may be a visual representation as shown on the three-dimensional representation of the drilled wellbore 414 shown in FIG. 3. This depiction may be accompanied with associated positional data that is displayed in a textual format.

At step 912, the method 900 may include generating a depiction of the drill plan with the controller. This depiction can be a three-dimensional depiction of the drill plan 410 such as that shown in FIGS. 4-7. The depiction can also include a three-dimensional depiction of the actual drill path (referenced as the drilled wellbore) to visually indicate to a user the distance and direction to the drill plan.

At step 914, the method 900 may include generating a lithology window corresponding to the drill plan. This lithology window may be similar to the lithology window 510 shown in FIG. 6. In some embodiments, the lithology window corresponding to the drill plan is generated using lithology data from external sources, such as geology surveys or reports. This data may be received by the controller through an input source, such as a computer module or an internet link. The lithology window may display formations around the drill plan visually.

At step 916, the method 900 may include generating a lithology window corresponding to the position of the toolface. This lithology window may be similar to the lithology window 510 shown in FIGS. 4-6. In some embodiments, the lithology window corresponding to the position of the toolface is generated using data from a down hole gamma sensor. This sensor may measure gamma counts from the formations around the drill bit as it passes through them. The lithology window may display these formations visually.

At step 918, the method 900 may include comparing the lithology windows corresponding to the drill plan and the position of the toolface. In some embodiment, the lithology windows may be compared visually, such as comparing the placement and size of formations and formation boundaries. The comparison may highlight differences between the windows visually, such as shading areas of discrepancy red. Additionally, the comparison may include overlaying the lithology windows to create a combined image of the formations. In some embodiments, the comparison may include comparing the data sources and generating a new lithology window based on this comparison. In some embodiments, if discrepancies are found between the lithology windows or the data used to generate the lithology windows, the system may download updated geology information. For example, if the external source is found to be inaccurate, the system may be configured to import an updated earth model to correlate with the formation boundaries detected by the down hole gamma probe.

At step 920, the method 900 may include generating a visualization comprising the depiction of the position of the toolface, the depiction of the drill plan, and the comparison of the lithology windows. This visualization can appear as a simulated camera view such as that shown in HMI 500 in FIGS. 4-6. The position of the toolface may also include earlier positions of the toolface such that a drilled wellbore or a drill history is displayed in the visualization. In some implementations, lithology windows may be displayed intersecting or adjacent to the position of the toolface and/or the drill plan. As discussed above, the comparison of the lithology windows may include the generation of a third lithology window using verified data. In some implementations, the method can further include generating visualizations to show variations between the position of the toolface and the depiction of the drill plan. In particular, indicators such as the advisory segment 404 and indicator 408 may be included in the visualizations to indicate a recommended steering path for moving the toolface and thus the drilling motor toward the drilling plan. The visualization may be controlled by a user in various ways. For example, a user can view lithology data associated with various times during the drilling operation by moving the lithology windows to a given position along the drill plan or drilled wellbore. Furthermore, a user may "detach" the simulated camera from the drilled wellbore and view the drill history, the drill plan, and/or the lithology windows from various angles.

At step 922, the method 900 may include directing the drilling apparatus using the three-dimensional visualization as a reference. In some cases, the visualization includes aspects of the three-dimensional display of FIG. 3. This display may be included on the same device and a user may be able to access information about the location and orientation of the toolface, creating a more general, intuitive view of the down hole environment while providing more specific data concerning important aspects of the toolface where needed. The addition of the lithology windows may provide an intuitive assessment of the formations between the current location of the BHA and the drill plan.

At step 924, the method 900 may optionally include updating the visualization with received sensor data. In some implementations, the visualization is updated with sensor data from surveys that are conducted at regular intervals along the route of the toolface. The visualization may also be updated at regular time intervals according received sensor data, such as every five or ten seconds, for example. In some cases, a two-dimensional overlay such as the concentric circular grid 402 and concentric rings shown in FIG. 3 is updated with time-dependent sensor data. Furthermore, the visualization may be updated with comparisons of the lithological information presented in the lithology windows.

In an exemplary implementation within the scope of the present disclosure, the method 900 repeats after step 922 or 924, such that method flow goes back to step 904 and begins again. Iteration of the method 900 may be utilized to characterize the performance of toolface control. Moreover, iteration may allow some aspects of the visualization to be refined each time a survey is received. For example, the advisory width and direction may be refined to give a better projection to be used in steering the toolface.

In view of all of the above and the figures, one of ordinary skill in the art will readily recognize that the present disclosure introduces a drilling apparatus including: a drill string comprising a plurality of tubulars and a drill bit; a first sensor system connected to the drill string and configured to detect one or more measurable parameters of a drilled wellbore and lithology indicating parameters; a controller in communication with the first sensor system, wherein the controller is operable to generate a three-dimensional depiction of a location of the drill bit based on the one or more measurable parameters of the drilled wellbore, wherein the controller is operable to receive lithology information, wherein the controller is operable to generate a depiction of lithology formations near the drilling apparatus based on the received lithology information; and a display device in communication with the controller, the display device configured to display to an operator a visualization comprising the three-dimensional depiction of the location of the drill bit and the depiction of the lithology formations.

In some implementations, the controller is operable to generate a three-dimensional depiction of a drill plan, wherein the visualization further includes the depiction of the drill plan. The first sensor system may comprise one or more lithology sensors capable of detecting lithology information, wherein the controller is operable to receive the lithology information from the one or more lithology sensors. The depiction of the lithology formations may be based on the lithology information received from the one or more lithology sensors. The depiction of the lithology formations may also include a comparison of lithology data from two or more data sources including a gamma sensor.

In some implementations, the comparison of lithology data is displayed as a lithology window comprising matching data from the two or more sources. the depiction of the lithology formations may be a window configured to visually represent lithology formations around the drilled wellbore. The depiction of the lithology formations may be a window configured to visually represent lithology formations between a position of the drill bit and a drill plan.

In some implementations, the visualization further comprises a representation of the one or more measurable parameters of the drilled wellbore. The one or more measurable parameters of the drilled wellbore may include an inclination measurement, an azimuth measurement, a toolface angle, and a hole depth. The controller may be configured to generate a three-dimensional depiction of the drill string, and wherein the visualization further comprises the three-dimensional depiction of the drill string. The drilling apparatus may include a motor located between a distal end of the drill string and the drill bit that is configured to drive the drill bit.

An apparatus for steering a bottom hole assembly is provided, which may include: a controller configured to receive data representing measured parameters indicative of positional information of a bottom hole assembly comprising a drill bit on a drill string in a down hole environment, wherein the controller is operable to generate a three-dimensional depiction of a most recent drill bit position based on the measured parameters indicative of positional information, wherein the controller is operable to generate a three-dimensional depiction of a drill plan, wherein the controller is operable to generate a first depiction of a lithology formation; the controller being arranged to receive and implement steering changes from an operator to steer the drill string; and a display in communication with the controller viewable by an operator, the display configured to display a visualization comprising the three-dimensional depiction of the most recent drill bit position, the three-dimensional depiction of the drill plan, and the first depiction of the lithology formation.

In some implementations, the controller is further configured to generate a second depiction of a lithology formation. The first depiction of the lithology formation may be a first window visually representing a lithology formation around the drill string, wherein the second depiction of the lithology formation is a second window visually representing a lithology formation around the drill plan. The controller may be configured to generate a three-dimensional depiction of a drill string, and wherein the visualization further comprises the three-dimensional depiction of the drill string. The controller may be configured to generate a two-dimensional overlay representing a plurality of prior drill bit positions centered on the three-dimensional depiction of the most recent drill bit position, and wherein the visualization further comprises the two-dimensional overlay centered on the three-dimensional depiction of the most recent drill bit position.

A method of directing the operation of a drilling system is provided, including: inputting a drill plan into a controller in communication with the drilling system; driving a bottom hole assembly comprising a drill bit disposed at an end of a drill string; receiving sensor data from one or more sensors adjacent to or carried on the bottom hole assembly; calculating, with the controller, a position of the drill bit based on the received sensor data; calculating, with the controller, a positional difference between the drill plan and the calculated position of the drill bit; receiving, with the controller, lithology information about lithology formations near the drilling system; displaying a three-dimensional visualization based on the drill plan, the sensor data, the calculated position of the drill bit, and the lithology information; and using the display as a reference in directing a change of position of the drill bit.

In some implementations, the visualization further comprises a three-dimensional depiction of the calculated position of the drill bit and a three-dimensional depiction of the drill plan. The visualization may further include one or more lithology windows configured to visually display lithology formations around the drilling system based on the received lithology information.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A drilling apparatus comprising:

a drill string comprising a plurality of tubulars and a drill bit;

a first sensor system connected to the drill string and configured to detect one or more measurable parameters of a drilled wellbore and lithology indicating parameters;

a controller in communication with the first sensor system, wherein the controller is operable to generate a three-dimensional depiction of a location of the drill bit based on the one or more measurable parameters of the drilled wellbore, wherein the controller is operable to receive lithology information, wherein the controller is further operable to generate a three-dimensional depiction of a drill plan, wherein the controller is operable to generate a first lithology window representing lithology formations around a first location along the drilled wellbore, a second lithology window representing lithology formations around a second location along the drill plan, and a comparison of the first and second lithology windows based on the received lithology information; and a display device in communication with the controller, the display device configured to display to an operator a visualization of an underground environment from a perspective looking down the drill string, the visualization comprising the three-dimensional depiction of the location of the drill bit, the three-dimensional depiction of the drill plan, the first lithology window, the second lithology window, and a third lithology window based on windows, wherein a user is able to direct the drill bit using the comparison of the first and second lithology windows as a reference.

2. The drilling apparatus of claim 1, wherein the first sensor system comprises one or more lithology sensors capable of detecting lithology information, wherein the controller is operable to receive the lithology information from the one or more lithology sensors.

3. The drilling apparatus of claim 2, wherein the first lithology window is based on the lithology information received from the one or more lithology sensors.

4. The drilling apparatus of claim 3, wherein the first lithology window comprises a comparison of lithology data from two or more data sources including a gamma sensor.

5. The drilling apparatus of claim 4, wherein the comparison of lithology data is displayed in the first lithology window comprising matching data from the two or more data sources.

6. The drilling apparatus of claim 3, wherein the first lithology window is displayed normal to the drilled wellbore.

7. The drilling apparatus of claim 3, wherein the comparison of the first and second lithology windows is displayed between the location of the drill bit and the drill plan.

8. The drilling apparatus of claim 1, wherein the visualization further comprises a representation of the one or more measurable parameters of the drilled wellbore.

9. The drilling apparatus of claim 1, wherein the one or more measurable parameters of the drilled wellbore comprise an inclination measurement, an azimuth measurement, a toolface angle, and a hole depth.

10. The drilling apparatus of claim 1, wherein the controller is configured to generate a three-dimensional depiction of the drill string, wherein the visualization further comprises the three-dimensional depiction of the drill string, wherein the first lithology window is displayed normal to the three-dimensional depiction of the drill string.

11. The drilling apparatus of claim 1, further comprising a motor located between a distal end of the drill string and the drill bit that is configured to drive the drill bit.

12. The drilling apparatus of claim 1, wherein the display device is further configured to display the third window between the three-dimensional depiction of the location of the drill bit and the three-dimensional depiction of the drill plan.

13. The drilling apparatus of claim 1, wherein the visualization further comprises the depiction of the drill plan extending through a cross-sectional view of the lithology formations in the first lithology window.

14. The drilling apparatus of claim 1, wherein the first lithology window is affixed to a particular location along the drilled wellbore selected by the user in the visualization.

15. The drilling apparatus of claim 4, wherein the first lithology window includes two or more textures representing the lithology formations, the two or more textures based on the comparison of the lithology data from the two or more data sources.

16. The drilling apparatus of claim 1, wherein the visualization further comprises an advisory segment.

* * * * *